United States Patent [19]

Ferguson et al.

[11] 4,021,192

[45] May 3, 1977

[54] FURNACE SYSTEM FOR AND METHOD OF MELTING AND PREHEATING METAL

[75] Inventors: Jack A. Ferguson, Richmond, Va.; Clarence D. Korn, Florence, Ala.

[73] Assignee: Reynolds Metals Company, Richmond, Va.

[22] Filed: Dec. 22, 1975

[21] Appl. No.: 643,516

[52] U.S. Cl. ..... 432/13; 432/72; 432/28; 432/164; 432/179; 432/181; 266/200; 266/901

[51] Int. Cl.[2] ..... F27B 14/00

[58] Field of Search ..... 432/13, 28, 48, 72, 432/161, 82, 163–166, 179–181, 187, 195, 205; 266/200, 901

[56] References Cited

UNITED STATES PATENTS

| | | | |
|---|---|---|---|
| 1,279,697 | 9/1918 | Hook | 432/181 |
| 1,658,332 | 2/1928 | Hanley, Jr. | 432/82 |
| 1,844,604 | 2/1932 | Schwab | 432/82 |
| 1,851,738 | 3/1932 | Teetor | 432/82 |
| 3,353,807 | 11/1967 | Sixel et al. | 266/901 |
| 3,533,612 | 10/1970 | Morton | 266/901 |
| 3,764,259 | 10/1973 | Alexander, Jr. | 432/180 |

*Primary Examiner*—John J. Camby
*Assistant Examiner*—Henry C. Yuen
*Attorney, Agent, or Firm*—Glenn, Lyne, Gibbs & Clark

[57] ABSTRACT

This invention provides a furnace system for and method of melting metal charges which utilizes hot gases generated by a burner, and are ordinarily discharged from the furnace as waste, for the dual purpose of preheating metal to be subsequently melted and preheating combustion air which is used to provide more efficient operation of the furnace burner.

20 Claims, 1 Drawing Figure

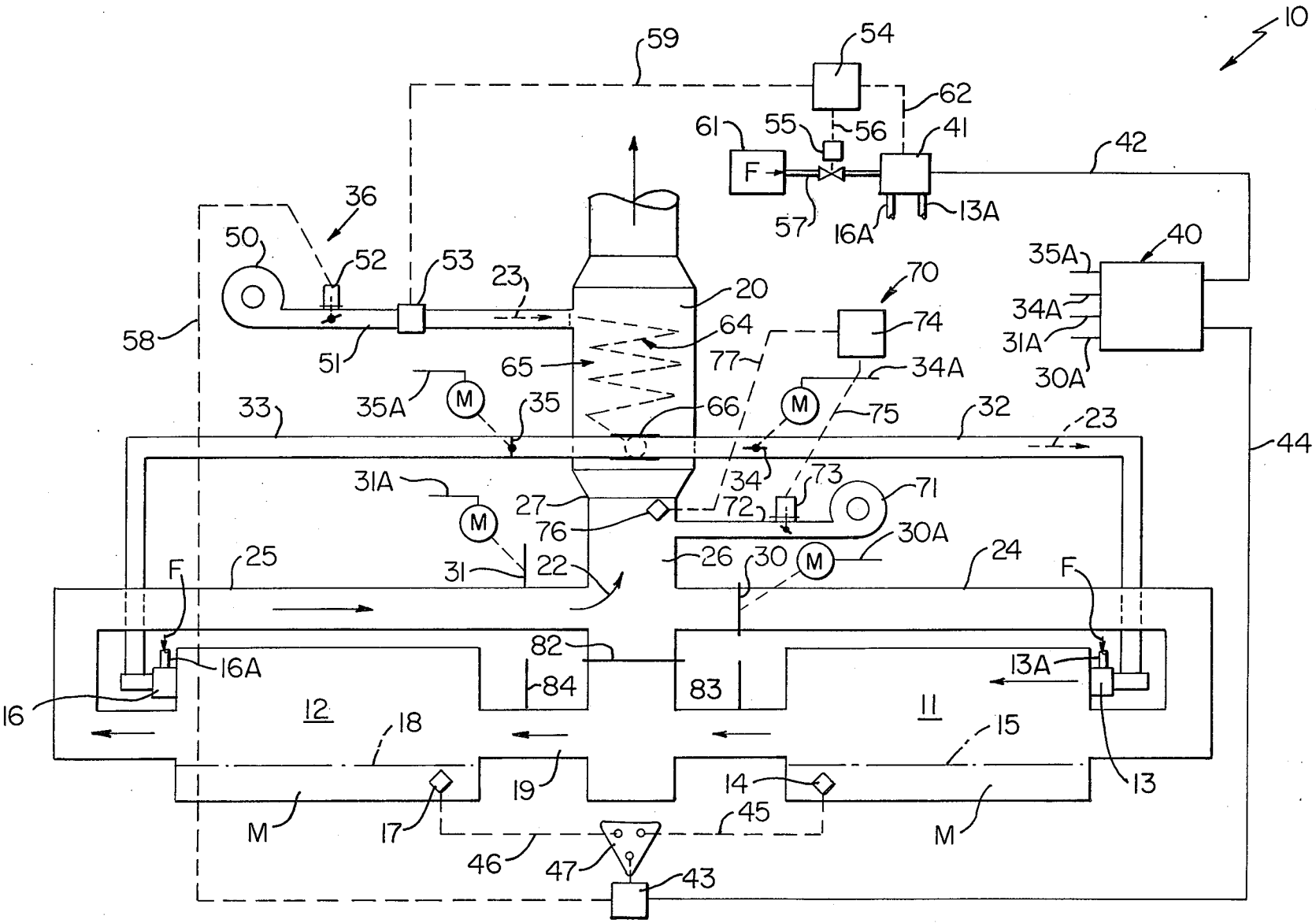
10
44
40
42
35A
34A
31A
30A
23
13
F
13A
15
M
11
24
32
62
41
13A
70
74
34A
71
30A
54
56
16A
75
73
55
57
M
30
14
45
61
F
20
64
77
66
34
72
26
83
43
59
76
27
22
82
84
47
19
46
65
35
23
31
53
M
M
35A
31A
17
18
36
52
51
12
50
33
25
16A
M
F
58
16

FURNACE SYSTEM FOR AND METHOD OF MELTING AND PREHEATING METAL

BACKGROUND OF THE INVENTION

The need exists for an efficient furnace system which may be used to melt scrap metal for reuse, as desired.

However, the most commonly used previously proposed furnace systems for melting scrap, particularly non-ferrous metal scrap, are not particularly efficient because they require preheating of the scrap in a particular container at one location and then moving the preheated scrap and transfer thereof into another container for melting.

Recently, another consideration which has been introduced in the processing of scrap metal is the comparative scarcity and high cost of fuel making it necessary that a melting furnace, or the like, be operated more efficiently. Heretofore, the relatively low cost of fuel for a furnace made it uneconomical to employ more sophisticated devices or techniques in an effort to reduce operating costs whereby previously proposed furnace systems were not particularly efficient because they did not operate at maximum fuel economy.

One solution to the operation of a furnace in a more efficient manner is the utilization of some form of device to extract heat from the hot gases discharged from the furnace and employing such heat for one or more purposes in connection with the operation of such furnace; and, devices commonly referred to as recuperators have been proposed heretofore for preheating combustion air to the furnace.

It has also been proposed in connection with smelting furnaces having a plurality of chambers, to heat and melt a charge of material in a melting chamber and convey the hot exhaust gases from the melting chamber to another chamber for the purpose of preheating another charge of material.

Therefore, the need exists for an efficient furnace system which among other uses may be employed to melt scrap metal and which overcomes many of the inefficiencies and problems of previously proposed furnace systems.

SUMMARY

This invention provides a furnace system for preheating and melting metal in a substantially continuous and uninterrupted manner without the need to preheat the metal being melted in one container and then transferring the preheated metal to another container for melting.

This invention provides a furnace system for and method of melting metal which utilizes hot gases generated by a furnace burner and ordinarily discharged from the furnace as waste for the dual purpose of preheating metal to be subsequently melted and preheating combustion air which is used to provide more efficient operation of the furnace.

Further, this invention provides a recuperator which is protected from damage due to overheating by the controlled dilution of the hot stack gases prior to the gases contacting the recuperator.

Other details, features, objects, uses and advantages of this invention will become apparent from the embodiment thereof presented in the following specification, claims, and drawing.

BRIEF DESCRIPTION OF THE DRAWING

The accompanying drawing is a schematic presentation of a present preferred embodiment of a furnace system for and method of melting and preheating material.

DESCRIPTION OF ILLUSTRATED EMBODIMENT

Reference is now made to the drawing which illustrates a furnace system for and method of melting and preheating material which is designed generally by the reference numeral 10 and such furnace system and method 10 are particularly adapted to preheat and melt metal such as aluminum scrap in a substantially continuous and uninterrupted process; and, as will be apparent from the following description the preheating and melting may be readily achieved without the need for preheating the metal in one container and then transferring the preheated metal into another container for final melting thereof.

As seen in the drawing the furnace system 10 comprises a first furnace 11 and a second furnace 12 serving alternately as a melting and a preheating furnace and although such furnaces may be of any suitable type known in the art the furnaces are preferably reverberatory furnaces. The furnaces 11 and 12 are suitably supported and preferably in aligned end-to-end relation with each furnace 11 and 12 having an opening for introducing metal to be preheated and melted and means for removing the molten metal and such removing means may be in a depressed area or recess having a suitable plugged opening therein and upon removal of the associated plug molten metal readily flows from such opening by gravity.

The first furnace 11 has a first variable capacity or output burner 13 (one is shown but additional burners may be provided) and a first temperature sensor 14 for sensing the temperature of a first charge of metal therein and such metal is designated by the reference letter M and a level thereof is indicated by a dot-dash line 15 in the furnace 11.

The second furnace 12 has a second variable capacity or output burner 16 (one is shown but additional burners may be provided) and a second temperature sensor 17 for sensing the temperature of a second charge of metal also designated by the reference letter M therein and the level of such metal is indicated by another dot-dash line 18 in the furnace 12.

The furnaces 11 and 12 are connected in their aligned end-to-end relation by a connecting duct 19 and have a recuperator 20 operatively connected thereon; and, in essence, such recuperator is in the form of an air-to-air heat exchanger. The recuperator 20 is used to extract heat from hot gases 22 generated by either one or the other of the furnace burners 13 or 16 to preheat combustion air which is designated by arrows 23 and as will be described in more detail subsequently.

The furnace system 10 has a first hot gas discharge duct 24 and a second hot gas discharge duct 25 operatively connected from the first furnace 11 and second furnace 12 respectively to the recuperator 20 and in this example such hot air ducts 24 and 25 are connected through a stack which may be in the form of a vertical stack 26 and such stack has the recuperator 20 installed or connected in its upper portion as illustrated at 27. The furnace system 10 also has a first valve 30 and a second valve 31 installed in the first hot gas discharge duct 24 and the second hot gas discharge duct 25 respectively for controlling the flow of hot gases therethrough.

The furnace system 10 also has a first combustion air duct 32 operatively connected between the recuperator 20 and the burner 13 of furnace 11 and a combustion air duct 33 operatively connected between the recuperator 20 and the burner 16 of furnace 12. To control the flow of combustion air through the ducts 32 and 33 the furnace system 10 has a first valve 34 in the duct 32 and a second valve 35 in the duct 33. The valves 34 and 35 are used to control flow of combustion air through either duct 32 or 33 in a selective manner depending upon the positions of valves 34 and 35 and the operation of these valves during operation of the furnace system will be described in more detail later.

The furnace system 10 has combustion air supply blower means which is designated generally by the reference numeral 36 and although such combustion air supply means will be described in more detail subsequently such supply means is provided to assure provision of an adequate supply of combustion air through the recuperator 20 for preheating thereof by hot gases 22 provided therethrough from either the hot gas discharge duct 25 as shown in the drawing or from the hot gas discharge duct 24 which also provides hot gases 22 in the course of continuous operation of the furnace system 10.

The furnace system 10 has furnace control means which may include a control system or apparatus which is designated generally by the reference numeral 40 and such control means is operatively associated with the burners 13 and 16 through associated fuel and air control devices, temperature sensors 14 and 17 and their associated devices, and valves 30, 31, 34, and 35 to provide preheated combustion air to a selected burner and control the flow of hot gases from a melting furnace to a preheating furnace to assure operation of the furnace system 10 with optimum efficiency and as will now be described in more detail.

In particular, the burners 13 and 16 are provided with the correct amount of fuel through lines 13A and 16A respectively from a fuel flow monitor 41 which is operatively connected in the control apparatus 40 by a suitable connection 42. The control apparatus 40 operatively associates with the temperature sensors 14 and 17 by being suitably connected by a connection 44 from the control apparatus 40 to a bath temperature controller 43 which is connected by connectors 45 and 46 to the temperature sensors 14 and 17 respectively through a bath temperature control selector switch 47.

The control apparatus 40 is connected to the valve 30 by a suitable connection 30A to a motor M of valve 30, to valve 31 by a suitable connection 31A to a motor M of valve 31, to valve 34 by a suitable connection 34A to a motor M of valve 34, and to valve 35 by a suitable connection 35A to a motor M of valve 35 whereby the control means operates to provide preheated combustion air to the first burner 13 with such burner operating at full output to melt a first charge of metal M therein with hot gases 22 from the furnace 11 flowing through the connecting duct 19 and through the furnace 12 to preheat a second charge of metal M in the furnace 12 with the hot gases 22 continuing through the hot gas discharge duct 25 through the lower portion of the stack 26 to the recuperator 20 to also preheat the combustion air 23; and, such combustion air 23 is supplied to the burner 13 of the furnace 11 in the operating condition of the system 10 which is illustrated in the drawing and in such operating condition the furnace 11 is at some point in the operating cycle wherein a charge of metal M therein is partially melted while the melting action continues and the metal M in the second furnace 12 is being preheated.

The furnace system control means operates such that the temperature sensor 14 senses the temperature of a first charge of metal M in the furnace 11 and when such first charge reaches pouring temperature the first burner 13 is automatically turned off and the second burner 16 is turned on and this is achieved by a signal through the bath temperature selector switch 47 to the bath temperature controller 43 which in turn provides a signal to the control apparatus 40. The apparatus 40 provides signals to the motors M of and thus to valves 30, 31, 34, and 35 through associated connections 30A, 31A, 34A, and 35A so that these four valves are operated so that the preheated combustion air 23 is supplied to the furnace 12 and flow of hot gases through the connecting duct 19 is reversed while modulating the heat output of the burner 16 using the temperature sensor 14 to maintain the pouring temperature of the charge M of metal in the furnace 11 until removal thereof. The modulation of the heat output of the burner 16 by sensor 14 is achieved by provision of a temperature signal to apparatus 40 which in turn controls the fuel flow monitor 41 to control fuel flow to burner 16.

Removal of the molten metal in furnace 11 is achieved by removal of the plug in its outflow device to allow outflow by gravity whereupon the furnace 11 is ready to be recharged; and, upon recharging of furnace 11 the furnace control is transferred by manual operation of temperature selector switch 47 to transfer control of the operation of the burner 16 to the temperature sensor 17 associated therewith. The burner 16 is then operated to melt the second charge of metal M therein with the hot gases from the second furnace flowing through the connecting duct 19 and through the first furnace 11 to preheat the new charge in the furnace 11 with the hot gases from the second furnace 12 continuing through the hot gas discharge duct 24 through the lower portion of the stack 26 to the recuperator 20 to also preheat the combustion air which is supplied to the burner 16 through the duct 33. This flow of hot gases through duct 24 is achieved by closing valve 31 and opening valve 30 and the flow of heated combustion air to the burner 16 is achieved by closing the valve 34 and opening the valve 35.

As previously mentioned the furnace system 10 comprises combustion air supply means 36 and in this example of the invention such combustion air supply means comprises a combustion air blower 50 which is adapted to supply ambient air through a duct 51 to the recuperator 20, and the duct 51 has a control valve 52 installed therein which controls the amount of ambient air introduced in the duct 51 and hence into the recuperator 20. The combustion air supply means 36 also comprises combustion air flow monitor 53 which is operatively connected to a fuel-air ratio controller 54 by a connection 59 and the operation of the controller 54 will be described in more detail subsequently. The position of the control valve 52 is controlled by a connection 58 from the bath temperature controller 43 to thereby control the amount of ambient air introduced based on the demand from the variable output burners 13 or 16. The fuel-air ratio controller 54 may be of a suitable construction and is operatively connected to a fuel flow control valve assembly 55 by a connection 56; and, the fuel flow control valve assembly 55 is supplied with fuel through a conduit 57 from a supply thereof which is indicated schematically by rectangular block 61. The fuel-air ratio controller 54 is also suitably connected to the fuel flow monitor 41 by a connection 62.

As previously mentioned the recuperator 20 is installed in the hot gas exhaust stack 26 and such stack communicates with the connecting dust 19; and, the recuperator 20 has passage means therein designated generally by the reference numeral 64 which enables the ambient air supplied thereto through duct 51 to be heated by traversing across the recuperator 20 a plurality of times as indicated at 65 to provide heating of the combustion air by the hot gases 22 from either furnace 11 or 12 and in the illustration of the drawing hot gases are provided from the duct 25 of furnace 12. The passage means 64 has a common connection 66 and the connection 66 communicates with duct 32 at one end duct 33 at the opposite end thereof.

The furnace system 10 comprises air dilution means which is designated generally by the reference numeral 70 for diluting hot gases 22 entering the recuperator 20 to reduce the temperature of such gases and thereby protect the recuperator. The dilution means 70 operates independently of the control apparatus 40 and comprises a dilution air blower 71 which has its outlet in flow communication with the inlet of the recuperator 20 by means of a duct 72; and, the dilution means 70 includes an adjustable valve 73 which controls the amount of ambient air used for cooling purposes provided by the blower 71 through the duct 72. The adjustable valve 73 is controlled by a recuperator air inlet temperature controller 74 shown operatively connected to a recuperator air inlet temperature controller 74 by a connection 75; and, the controller 74 serves to control the position of the valve 73 to control the amount of air from the blower 71 allowed to pass through the duct 72.

The controller 74 is controlled by a temperature sensor 76 which is operatively connected to the controller 74 by a connection 77. Thus, once the inlet temperature to the recuperator 20 reaches a predetermined level the temperature sensor 76 provides a signal to the controller 74 which in turn operates the valve 73 to allow more cooling ambient air to be introduced upstream of the temperature sensor 76 causing a mixing of the cooling ambient air with the exhaust gases 22 to cool the mixture thereof and once the temperature is reduced below the temperature which caused the temperature sensor 76 to provide its signal to the controller the valve 73 is returned to its initial position.

The temperature controller 74 operates automatically to, in essence, modulate the amount of air flow through the duct 72 to assure that the temperature into the recuperator 20 does not exceed a desired temperature as set on the controller 74 and it will be appreciated that this operation is a continuously controlled operation. It will be appreciated that the air blower 71 operates in a continuous manner; however, the amount of air from the blower 71 introduced upstream of the recuperator 20 is precisely controlled by the movement of the valve 73 in restricting flow through its duct 72 and as controlled by the controller 74. Further, the air dilution means 70 serves to prevent overheating by the hot gases 22 and thus serves as a system temperature protective device; however, the temperature through the recuperator is allowed to remain at a high level to provide the desired preheating of combustion air 23.

The amount of combustion air required by either burner 13 or 16 is determined by whether the burner in question is operating at full capacity or at a reduced capacity; and, the amount of combustion air supplied to each burner 13 or 16 is controlled by the bath temperature controller 43 using the connection 58. Accordingly, when the operation of the furnace system is such that either temperature sensor 14 or 17 signals that maximum heating be provided by an associated burner 13 or 16 respectively the amount of fuel flow is increased and the valve 52 is opened a comparatively large amount so that ambient air flow through the duct 51 is increased to support the maximum operation of the associated burner. When less heating is required as is the case when melting of a charge in one furnace has been completed and the molten metal temperature of such charge is monitored by the burner of the other furnace the fuel flow to the required burner is decreased and valve 52 is opened a lesser amount.

The combustion air flow monitor 53 in the duct 51 is operatively connected to the fuel-air ratio controller 54 as mentioned previously; and with increased demand for combustion air a larger signal is provided through the connection 55 to the fuel-air ratio controller 54 which in turn signals the fuel control valve 55 to provide the required additional fuel F to the associated burner. The blower 50 also operates in a continuous manner and the amount of ambient air introduced by the blower 50 is controlled by the action of the valve 52 as determined by the controller 43. Thus, through the action of controller 43, fuel and air flow are both simultaneously controlled.

The furnace system 10 also has means for isolating either furnace 11 or 12 to enable maintenance thereof. Such isolation means comprises a plurality of three shut-off valves in the form of a stack shut-off valve 82 isolating the bottom portion of the stack 26 from the connecting duct 19, a shut-off valve 83 in the connecting duct 19 between the furnace 11 and the stack 26, and a shut-off valve 84 in the connecting duct 19 between the furnace 12 and the stack 26. During normal operation of the furnace system 10 the valves 83 and 84 are open while the valve 82 is closed so that there is unobstructed flow through the connecting duct 19 between the furnaces 11 and 12. In the event of malfunction of the furnace 11 requiring shut-down and maintenance thereof valve 83 is closed and valves 82 and 84 are opened; and, in the event of malfunction of furnace 12 requiring shut-down and maintenance thereof valves 82 and 83 are opened and valve 84 is closed. The valves 82, 83 and 84 are in the form of manually actuated shut-off valves or dampers.

During normal operation of the furnace system 10 it will be appreciated that the furnace doors of both furnaces 11 and 12 remain closed when either burner 13 or 16 is firing and each furnace 11 and 12 should be charged comparatively fast.

Further, it will be appreciated that in repairing or rebuilding either furnace will require that the other furnace be idle and isolated in the manner described in connection with the utilization of valves 82, 83, and 84.

The furnace system and method of this invention enable the continuous melting of metal utilizing a plurality of two furnaces; and, such furnace system and method enables the operation utilizing hot exhaust gases for preheating metal which is to be subsequently melted as well as for preheating combustion air whereby a furnace system operation can be achieved in a more efficient manner with conservation of fuel.

In this disclosure of the invention the control apparatus 40 has been illustrated in the drawing as a block diagram; however, it will be appreciated that the detailed construction of apparatus 40 has the required circuitry, control components, memory devices, power source, and the like, which are suitably interconnected in accordance with techniques to assure that the system control means provides the substantially automatic operation described herein whereby a detailed description of such detailed construction is not considered necessary and has not been presented.

It will also be appreciated that instead of utilizing the apparatus 40 in the control means for the furnace system to provide substantially automatic operation of the furnace system and method 10, the control of system and method 10 may be primarily manual whereby the thermocouple temperature selector switch 12 may be manually operated at the required point in the operating cycle and the various valves and certain of the controls may be similarly manually operated to provide essentially the same operation described herein in connection with the automatic operation.

In this disclosure of the invention the structural supports, power sources, and the like have not been shown for the various components disclosed herein, and it will be appreciated that such supports, power sources, and the like will be in accordance with techniques which are known in the art.

A number of temperature sensors such as the temperature sensors 14, 17, and 76, for example, are employed in the apparatus and method of this invention. These temperature sensors may be of any suitable construction which is utilized in the art and preferably such temperature sensors are in the form of commercially available thermocouples. In addition, it will be appreciated that these thermocouples provide their associated signal usually in the form of electrical signal through an associated electrical connection to an associated component to enable the operation thereof.

The various system components in the form of control devices, valves, etc., described herein in connection with the automatic operation of the system preferably are electrically powered by suitable actuators, motors, and the like. For example, the valves 30, 31, 34, and 35 are shown powered by electric motors M which are connected to their valves and energized and controlled to provide the previously described operations. However, it will be appreciated that the various components employed in the system and method of this invention may be powered by any suitable means.

While present exemplary embodiments of this invention, and methods of practicing the same, have been illustrated and described, it will be recognized that this invention may be otherwise variously embodied and practiced within the scope of the following claims.

What is claimed is:

1. A furnace system comprising, a first and a second furnace serving alternately as a melting and a preheating furnace, said first furnace having a first variable output burner and a first temperature sensor for sensing temperature of a first charge of metal therein, said second furnace having a second variable output burner and a second temperature sensor for sensing temperature of a second charge of metal therein, a connecting duct connecting said furnaces together, a recuperator, a first and a second hot gas discharge duct from said first and second furnaces respectively to said recuperator, a first and a second valve in said first and second hot gas discharge ducts respectively for controlling hot gas flow therethrough, a first and a second combustion air duct from said recuperator to said first and second burner respectively, a first and a second valve in said first and second combustion air duct respectively for controlling flow of combustion air therethrough, means for supplying combustion air to said recuperator to preheat said combustion air by hot gases provided therethrough from one of said hot gas discharge ducts, and control means for said furnace system operatively associated with said burners, temperature sensors, and valves to provide preheated combustion air to said first burner of said first furnace with said first burner operating at full output to melt a first charge of metal therein with hot gases from said first furnace flowing through said connecting duct and second furnace to preheat said second charge and said hot gases continuing through said second hot gas discharge duct to said recuperator to also preheat said combustion air which is supplied to said first burner.

2. A furnace system comprising, a first and a second furnace serving alternately as a melting and a preheating furnace, said first furnace having a first variable output burner and a first temperature sensor for sensing temperature of a first charge of metal therein, said second furnace having a second variable output burner and a second temperature sensor for sensing temperature of a second charge of metal therein, a connecting duct connecting said furnaces together, a recuperator, a first and a second hot gas discharge duct from said first and second furnaces respectively to said recuperator, a first and a second valve in said first and second hot gas discharge ducts respectively for controlling hot gas flow therethrough, a first and a second combustion air duct from said recuperator to said first and second burner respectively, a first and a second valve in said first and second combustion air duct respectively for controlling flow of combustion air therethrough, means for supplying combustion air to said recuperator to preheat said combustion air by hot gases provided therethrough from one of said hot gas discharge ducts, and control means for said furnace system operatively associated with said burners, temperature sensors, and valves to provide preheated combustion air to said first burner of said first furnace with said first burner operating at full output to melt a first charge of metal therein with hot gases from said first furnace flowing through said connecting duct and second furnace and said hot gases continuing through said second hot gas discharge duct to said recuperator to also preheat said combustion air which is supplied to said first burner, said control means for said system operating such that said first temperature sensor senses the temperature of said first charge and when said first charge reaches pouring temperature said first burner is turned off and said second burner is turned on whereupon said valves are operated so that preheated combustion air is supplied to said second furnace and flow of hot gases through said connecting duct is reversed while modulating the heat output of the second burner using said first temperature sensor to maintain said pouring temperature of said first charge until removal thereof, and upon recharging of said first furnace with a new charge said control means operates to transfer control of said second burner to said second temperature sensor and operate said second burner at full output to melt said second charge of metal in said second furnace with hot gases from said second furnace flowing through said connecting duct and first furnace to preheat said new charge in said first furnace with said hot gases continuing through said first hot gas disclosure duct to said recuperator to also preheat said combustion air which is supplied to said second burner.

3. A system as set forth in claim 2 and further comprising means isolating one of said furnaces to enable maintenance thereof.

4. A system as set forth in claim 3 and further comprising a hot gas exhaust stack communicating with said connecting duct, said stack having said recuperating installed therein and said isolating means comprises a plurality of shut-off valves comprising a stack shut-off valve isolating the bottom portion of said stack from said connecting duct, a shut-off valve in said connecting duct between said first furnace and said stack, and a shut-off valve in said connecting duct between said second furnace and said stack, said shut-off valves in said connecting duct being opened and said stack shut-off valve being closed during normal operation of said system.

5. A system as set forth in claim 2 in which said control means comprises means selectively controlling and monitoring fuel flow to said burners.

6. A system as set forth in claim 2 in which said first and second temperature sensors are in the form of thermocouples.

7. A system as set forth in claim 6 in which said control means comprises a thermocouple selector switch operatively connected between said first and second thermocouple and a temperature controller connected to said selector switch for automatic operation thereof.

8. A system as set forth in claim 2 in which said means for supplying combustion air through said recuperator comprises an air blower having an outlet, a combustion air supply duct connected between said outlet and said recuperator, and a control valve installed in said combustion air supply duct for controlling the flow of combustion air therethrough.

9. A system as set forth in claim 8 in which said control means comprises means selectively controlling and monitoring fuel flow to said burners and said means selectively controlling and monitoring fuel flow comprises a combustion air flow monitor operatively connected in said combustion air supply duct and providing a signal to said means selectively controlling and monitoring fuel flow through a fuel-air ratio controller.

10. A system as set forth in claim 2 and further comprising means for diluting hot gases entering said recuperator to reduce the temperature thereof and protect said recuperator.

11. A system as set forth in claim 10 in which said means for diluting hot gases comprises a continuously operating air blower.

12. A system as set forth in claim 10 in which said means for diluting hot gases comprises, a dilution air supply duct in flow communication with said recuperator, a dilution air blower connected to the inlet of said dilution air duct and providing dilution air to the inlet of said recuperator, a mixture temperature sensor sensing the temperature of the mixture of ambient air and hot gases entering said recuperator, a dilution air control valve controlling the amount of flow of dilution air through said dilution air duct into the inlet of said recuperator, and a dilution air control device operatively connected between said mixture temperature sensor and said dilution air control valve to control the flow area of said dilution air control valve and thus control the amount of ambient air introduced at the inlet of said recuperator based upon the temperature from said mixture temperature sensor.

13. A system as set forth in claim 12 in which said mixture temperature sensor is in the form of a thermocouple and said means for diluting hot gases operates independently of said control means for said furnace system.

14. A method of melting metal comprising the steps of, providing a first and a second furnace serving alternately as a melting and a preheating furnace, said first furnace having a first variable output burner and a first temperature sensor for sensing temperature of a first charge of metal therein, said second furnace having a second variable output burner and a second temperature sensor for sensing temperature of a second charge of metal therein, joining said furnaces together with a connecting duct, installing a recuperator adjacent said furnaces, connecting a first and a second hot gas discharge duct from said first and second furnaces respectively to said recuperator, installing a first and a second valve in said first and second hot gas discharge ducts respectively for controlling hot gas flow therethrough, connecting a first and a second combustion air duct from said recuperator to said first and second burner respectively, installing a first and a second valve in said first and second combustion air duct respectively for controlling flow of combustion air therethrough, supplying combustion air to said recuperator to preheat said combustion air by hot gases provided therethrough from one of said hot gas discharge ducts, and controlling said system with a control means operatively associated with said burners, temperature sensors, and valves to provide preheated combustion air to said first burner of said first furnace with said first burner operating at full output to melt a first charge of metal therein with hot gases from said first furnace flowing through said connecting duct and second furnace to preheat a second charge in said second furnace and said hot gases continuing through said second hot gas discharge duct to said recuperator to also preheat said combustion air which is supplied to said first burner.

15. A method of melting metal comprising the steps of, providing a first and a second furnace serving alternately as a melting and a preheating furnace, said first furnace having a first variable output burner and a first temperature sensor for sensing temperature of a first charge of metal therein, said second furnace having a second variable output burner and a second temperature sensor for sensing temperature of a second charge of metal therein, joining said furnaces together with a connecting duct, installing a recuperator adjacent said furnaces, connecting a first and a second hot gas discharge duct from said first and second furnaces respectively to said recuperator, installing a first and a second valve in said first and second hot gas discharge ducts respectively for controlling hot gas flow therethrough, connecting a first and a second combustion air duct from said recuperator to said first and second burner respectively, installing a first and a second valve in said first and second combustion air duct respectively for controlling flow of combustion air therethrough, supplying combustion air to said recuperator to preheat said combustion air by hot gases provided therethrough from one of said hot gas discharge ducts, and controlling said system with a control means operatively associated with said burners, temperature sensors, and valves to provide preheated combustion air to said first burner to said first furnace with said first burner operating at full output to melt a first charge of metal therein with hot gases from said first furnace flowing through said connecting duct and second furnace to preheat a second charge in said second furnace and said hot gases continuing through said second hot gas discharge duct to said recuperator to also preheat said combustion air which is supplied to said first burner, said controlling step comprising operating said control means such that said first temperature sensor senses the temperature of said first charge and when said first charge reaches pouring temperature said first burner is turned off and said second burner is turned on whereupon said valves are operated so that preheated combustion air is supplied to said second furnace and flow of hot gases through said connecting duct is reversed while modulating the heat output of the second burner using said first temperature sensor to maintain said pouring temperature of said first charge until removal thereof, and recharging said first furnace with a new charge whereupon said control means operates to transfer control of said second burner to said second temperature sensor and said second burner is then operated at full output to melt said second charge of metal in said second furnace with hot gases from said second furnace flowing through said connecting duct and first furnace to preheat said new charge in said first furnace with said hot gases continuing through said first hot gas discharge duct to said recuperator to also preheat said combustion air which is supplied to said second burner.

16. A method as set forth in claim 15 in which said control step comprises selectively controlling and monitoring fuel flow to said burners.

17. A method as set forth in claim 15 in which said step of supplying combustion air to said recuperator comprises supplying said combustion air using a continuously operating air blower supplying a combustion air duct which is in flow communication with said recuperator.

18. A method as set forth in claim 17 and further comprising the step of installing an air flow control valve in said combustion air duct for controlling the flow of air therethrough.

19. A method as set forth in claim 15 and further comprising the step of diluting hot gases entering said recuperator with ambient air to reduce the temperature thereof and protect said recuperator.

20. A method as set forth in claim 19 in which said diluting step comprises the step of introducing and mixing ambient air with the hot gases independently of said controlling step.

* * * * *